US005570172A

United States Patent [19]

Acquaviva

[11] Patent Number: 5,570,172

[45] Date of Patent: Oct. 29, 1996

[54] TWO UP HIGH SPEED PRINTING SYSTEM

[75] Inventor: Thomas Acquaviva, Penfield, N.Y.

[73] Assignee: Xerox Corporation, Stamford, Conn.

[21] Appl. No.: 374,365

[22] Filed: Jan. 18, 1995

[51] Int. Cl.[6] ..... G03G 21/00

[52] U.S. Cl. ..... 355/323; 271/9.13

[58] Field of Search ..... 355/308, 309, 355/317, 321, 322, 323; 271/9.11, 9.12, 9.13

[56] References Cited

U.S. PATENT DOCUMENTS

| | | | |
|---|---|---|---|
| 3,108,796 | 10/1963 | Dietrick | 271/9.13 |
| 3,758,103 | 9/1973 | Gianese | 271/9.13 |
| 4,052,054 | 10/1977 | Cardwell | 271/227 |
| 4,208,666 | 6/1980 | Paranjpe | 271/9.12 |
| 4,727,402 | 2/1988 | Smith | 355/319 |
| 5,057,869 | 10/1991 | Graves et al. | 355/233 |
| 5,178,383 | 1/1993 | Moser et al. | 271/299 |
| 5,253,856 | 10/1993 | Fuchi et al. | 271/9.12 |
| 5,433,425 | 7/1995 | Kubota et al. | 271/9.12 |

FOREIGN PATENT DOCUMENTS

WO92/14192 8/1992 WIPO .

OTHER PUBLICATIONS

Xerox Disclosure Journal—"Two-Up Recirculating Document Handler" Author: Richard E. Smith vol. 12, No. 4, Jul./Aug. 1987.

*Primary Examiner*—Robert Beatty

[57] ABSTRACT

In a high speed two up electronic printing system in which dual page images are concurrently printed side by side onto image substrate material and outputted as two parallel individual sheets paired laterally transverse the printing path direction, to increase printing throughput, a sheet output lateral sheet merging and stacking system laterally overlaps the two printed output sheets on top of one another in sheet pairs, and consecutively stacks the sheet pairs on top of one another, to provide a collated output, preferably using a compact a disk stacking system which laterally shifts and superposes the printed paired sheets on top of one another while both sheets of the pair are being arcuately supported and rotated for inversion. Also disclosed is a paired cut sheet input feeding and outside edge sheet registration and spacing system and an interrupted line printing system therefor.

6 Claims, 5 Drawing Sheets

TWO UP HIGH SPEED PRINTING SYSTEM

Disclosed is an improved, more compact, high speed electronic printing system with improved lateral merging of two-up printed sheets collated output, requiring less floor space, and providing more flexible image substrate input choices.

One specific feature of the embodiment disclosed herein is to provide a high speed two up electronic printing system, with a printing path direction, in which dual page images are concurrently printed onto dual image substrates paired side by side laterally transverse said printing path direction to increase printing throughput speed, the improvement in said two up printing system comprising a dual high capacity cut sheet feeding system for loading and feeding pairs of separate precut copy sheets into said printing path substantially in parallel to provide said paired side by side dual image substrates for said concurrent printing; a registration system for registering said paired side by side dual image substrate sheets with a space between said paired sheets; an electronic imaging system for line by line simultaneous printing of both of said opposite edge registered paired sheets with a non-imaging line space in said space between said paired sheets; said electronic imaging system printing two different page images on said paired sheets; and a sheet output lateral sheet merging and stacking system for consecutively laterally shifting and overlapping said printed paired sheets on top of one another and for stacking consecutive said said overlapped sheet pairs on top of one another, to provide a collated output of said two up printed precut copy sheets.

Further specific features provided by the system disclosed herein, individually or in combination, include those wherein said sheet output lateral sheet merging and stacking system comprises a disk stacking system in which said lateral shifting and overlapping of said printed paired sheets on top of one another is provided while said paired sheets are both arcuately held for increased beam strength and are both being inverted; and/or wherein said sheet output lateral sheet merging and stacking system laterally superposes said said printed paired sheets on top of one another while they are being arcuately supported and rotated; and/or wherein said registration system comprises a dual edge registration system for edge registering one edge of each of said paired side by side dual image substrate sheets to opposite lateral side edges of said printing path with a substantial space between said paired sheets; and/or wherein said sheet output lateral sheet merging and stacking system consecutively compiles and finishes plural said overlapped sheet pairs into plural bound collated sets; and/or a high speed two up electronic printing system, with a printing path direction, in which dual page images are concurrently printed side by side onto image substrate material, paired laterally transverse said printing path direction, and outputted as two parallel individual sheets, to increase printing throughput, the improvement in said two up printing system comprising a feeding system for feeding image substrate material into said printing path for said paired side by side dual dual image concurrent printing; an electronic imaging system for line by line simultaneous two up printing of two different page images onto said image substrate material; said two different page images being outputted as two differently printed said parallel individual sheets; and a sheet output lateral sheet merging and stacking system for laterally overlapping said two parallel individual printed output sheets on top of one another in sheet pairs, and for stacking consecutive said sheet pairs on top of one another, to provide a collated output of said two up printed sheets; wherein said sheet output lateral sheet merging and stacking system comprises a disk stacking system which laterally shifts and superposes said printed paired sheets on top of one another while both sheets of said pair are being arcuately supported and rotated for inversion.

By way of general background, as electronic printers increase in speed, and become more automatic, it is increasingly important to provide higher speed yet more reliable, and more accurate registration, of the image substrate, i.e., the printing media. Yet it is also desirable to be able to rapidly print out jobs with image substrate sheets of a variety or mixture of sizes, types, weights, colors, and materials, to provide better customer choices and flexibility and the capability of intermixed jobs. Although web or large roll paper feeding is well know for high speed printing, and has some cost and feeding reliability advantages, precut copy sheet feeding input allows much greater said flexibility in changing and/or providing said choices or variety in printed sheet output of a printer. Different sheets can be loaded into and fed from different feeding trays or drawers in the printer. Individual cut sheets can be fed from different automatically preselected trays at any time, and thus precollated jobs with intermixed sheets of different colors or other characteristics can be printed, unlike roll fed input. Precut sheet image substrates are also much easier to load into a printer. Typically, cut sheet is provided in easily lifted and easily loaded ream size packages. In contrast, large paper rolls are so heavy that they can only be moved and loaded with special dollys or transporters. Also, a roll paper supply can induce preset curl in the web, especially as it feeds out from near the small diameter central core of the roll. Furthermore, roll fed web input requires high speed cutting or chopping up of the web into separate sheets to provide useful output. That constant cutting not only requires extra machinery to maintain and sharpen, but also generates cutting noise and paper lint and/or edge scraps to collect and remove.

Art of particular comparative interest on such high speed two up web printing includes a recently noted very large, and large floor area, Pitney Bowes modular connected two up printing and mailing system which is roll (web) fed from a standard very large and heavy uncut paper roll input of approximately 17" (dual page) width and 6' initial diameter, and printed in side by side pairs of adjacent consecutive letter size image pages of a plural page bill or invoice. The two up printed single web is then center slit along its process direction into two separate webs, and the two webs are fed through long hanging loops and moved sideways to transversely overlap or merge on top of one another, then both webs are page chopped in a chopper into separate sheets and compiled in an operatively connecting "double-decker" or dual tray compiler, which switches its output between its two compiler trays, compiling plural pairs of pages into a collated set, and then feeding them on to another connecting module which can automatically fold and stuff each plural page collated set into addressed envelopes, for high speed automated on-line collated processing of multi-page bills, etc..

A German language patent publication with English Abstract of apparent interest on high speed two up cut sheet printing system is Siemens Nixdorf PCT WO 92/14192 of Aug. 20, 1992 by Hans Manzer, et al. (reportedly corresponding to EP 0 570 419 of Nov. 24, 1993).

By way of further background and prior art, the concept of "two up" or side by side printing of two page images in a copier from two document sheets input is known for signature printing both images onto a side of a single large cut sheet copy sheet. E.g., Xerox Corporation U.S. Pat. No. 4,727,402 to Richard E. Smith. Dual side by side original document sheet feeding for simultaneous copying thereof is also disclosed in IBM Corp. U.S. Pat. No. 4,052,054 issued Oct. 4, 1977 to Cardwell and Queener (of particular interest for its dual opposing outside edges sheet path edge registration); and the Xerox Disclosure Journal Vol. 12, No. 4, p. 179 et al, July/August 1987. Other art on two up signature scanning includes Xerox Corporation U.S. Pat. No. 5,057,869 by Graves, et al. It is also known to two up copy two document page images side by side onto a single large copy sheet and then slit such dual image copy sheets into two parallel copy sheets. E.g., Xerox Corporation U.S. Pat. No. 3,402,628 to Redding, noting especially Col. 1, the first paragraph; Xerox Corporation U.S. Pat. No. 4,559,855 to Schieck; and U.S. Pat No. 4,198,881. Dual but laterally separating parallel paired sheet feeding is also disclosed in U.S. Pat. No. 5,178,383.

By way of background as to sheet side registration systems, they are well known per se and thus need not be disclosed in detail herein. Examples of individual sheet feeding side registration systems and hardware include Xerox Corporation U.S. Pat. Nos. 4,411,418; 4,621,801; 4,744,555; 4,809,968; 4,836,527; 4,487,407; 4,919,318, and 5,065,998. Of particular interest are the angled roller edge registration systems of said 5,065,998 and 4,836,527.

As to art on lateral edge tamping of individual sheets in a disk stacker, per se, for partial set offsetting of one job set relative to another, there is noted for example Xerox Corporation U.S. Pat. No. 4,431,177 issued Feb. 14, 1984 to J. Berry, et al., and the below cited applications. However, such systems are for a relatively small lateral movement of sequential single sheets, and not a more than full sheet width lateral movement overlapping of two originally laterally separated parallel moving sheets. Further details of a disk stacker with combined or integral on-line collated job set compiling and stapling and stapled job sets stacking (as could be utilized for finishing in an example below), are disclosed in commonly assigned allowed U.S. application Nos. 08/214,521 and 08/214,525 filed Mar. 18, 1994, as attorney docket Nos. D/94024 and D/93678, by Naramore and Kramer.

It is well known and commonplace to program and execute imaging, printing, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, e.g., using standard logic circuits or a single chip using VLSI designs.

The control of exemplary sheet handling systems may be accomplished by conventionally actuating them by signals from the printer controller, directly or indirectly in response to simple programmed commands and from selected actuation or non-actuation of conventional user interface commands or switch inputs, such as switches selecting the number of copies to be made in that run, selecting simplex or duplex copying, selecting whether the documents are simplex or duplex, selecting particular desired copy sheet supply trays for particular printed sheets, etc. The resultant controller signals may conventionally actuate various conventional electrical solenoid or cam-controlled sheet deflector fingers, motors or clutches in the selected steps or sequences as programmed. Conventional sheet path sensors and switches, connected to the controller, may be utilized for sensing, timing and tracking the positions of sheets, as is well known in the art.

In the description herein the term "sheet" refers to a usually flimsy physical sheet of paper, plastic, or other suitable physical substrate for images. A "copy sheet" may be abbreviated as a "copy", or called "hardcopy". A "job" is normally a set of related sheets, usually a collated copy set copied from a set of original document sheets or electronic document page images, from a particular user, or otherwise related. A "simplex" sheet is one having its image and any page number on only one side or face of the sheet, whereas a "duplex" sheet has "pages", and normally images, on both sides. "Inboard" is towards the front of the machine.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of the embodiment thereof, including the drawing figures (approximately to scale) wherein:

Describing now in further detail the exemplary embodiment with reference to the Figures, there is schematically shown an otherwise conventional high speed xerographic laser printer 10, modified as will be described herein, by way of example of a suitable reproduction machine. Since such machines are well known in the art (merely as examples, the well known Xerox Corporation "4135", "5380" or "5385" high speed printers), and thus their otherwise conventional features need not be described herein.

Figure 1:
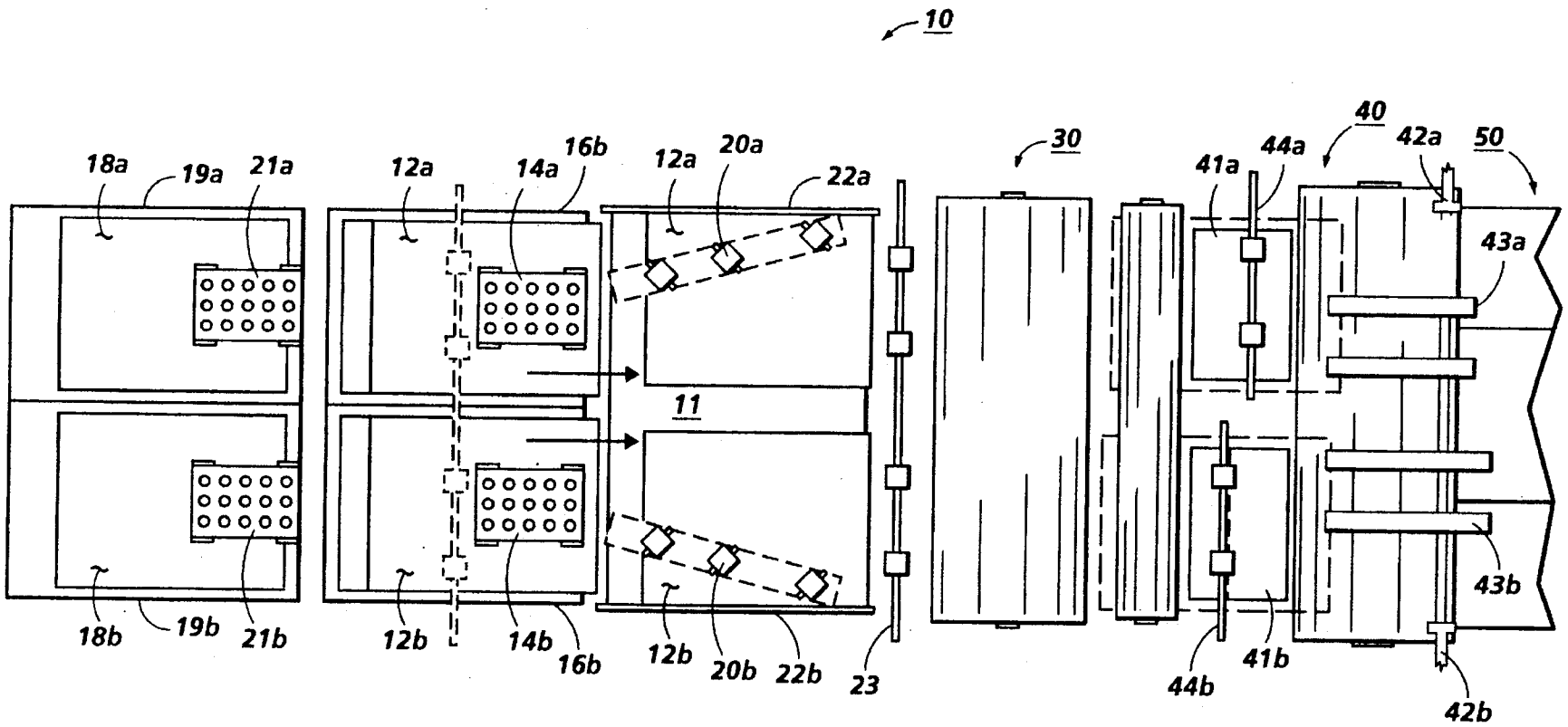
FIG. 1 is a schematic top view of one embodiment of the disclosed high speed two up cut sheets printing and merging system.
Figure 2:
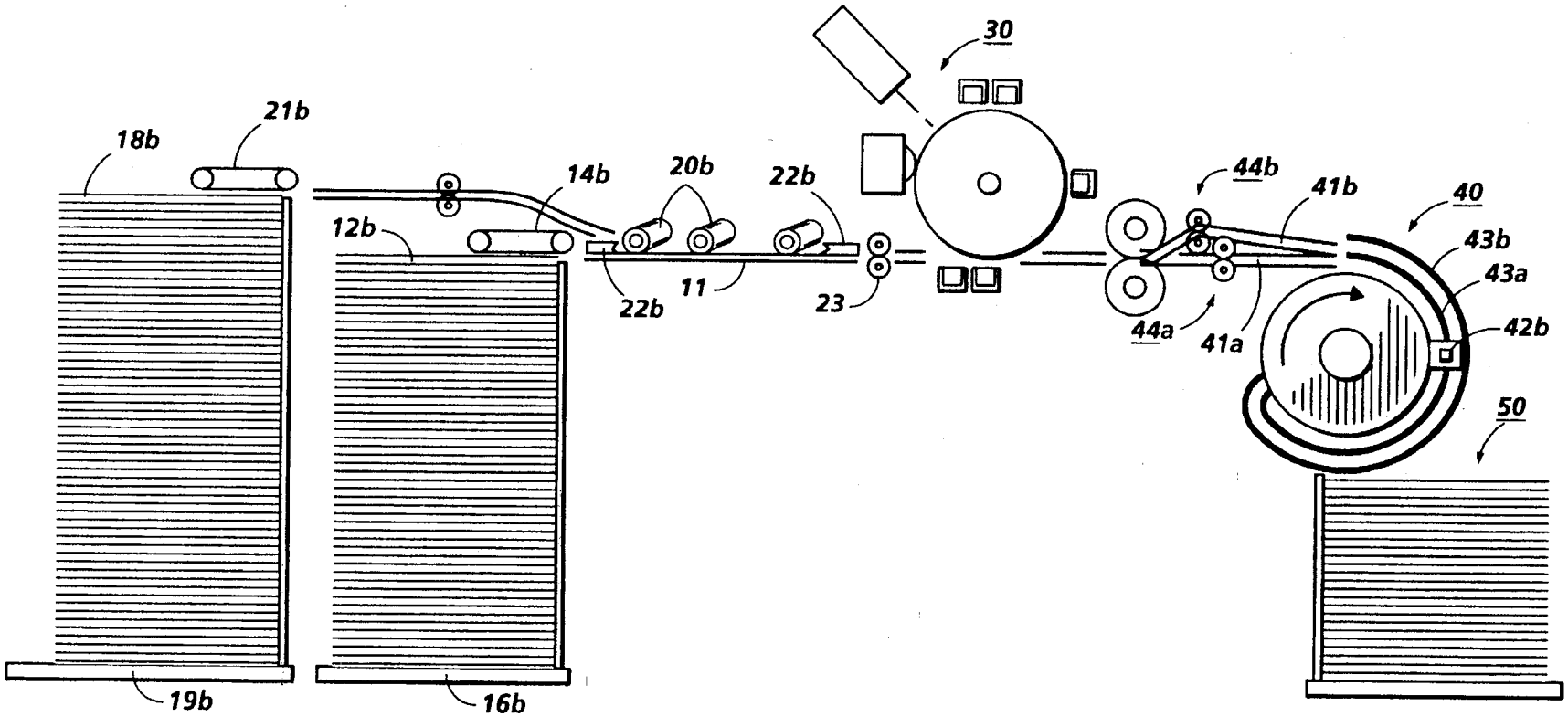
FIG. 2 is a schematic front view of the embodiment of FIG. 1.
Figure 3A:
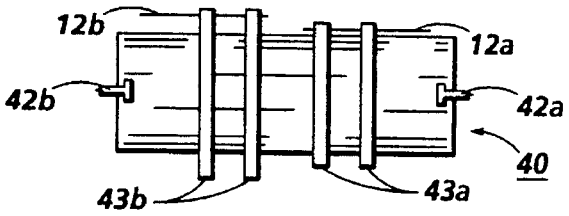
FIG. 3 (FIGS. 3A–3E) is an enlarged end view the disk stacker paired output sheets merging example of the embodiment of FIGS. 1 and 2, in different sequential operating positions thereof.
Figure 3B:
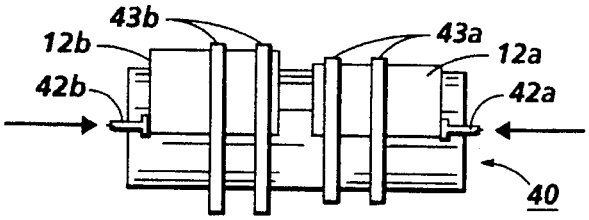
Figure 3C:
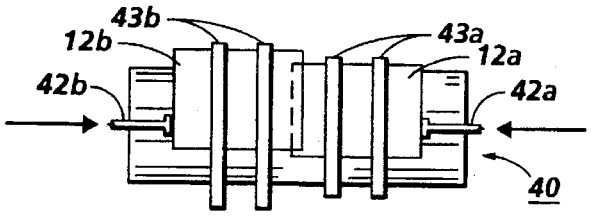
Figure 3D:
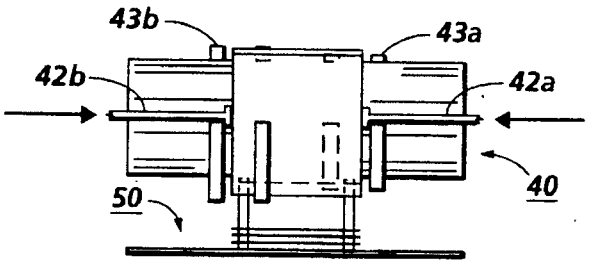
Figure 3E:
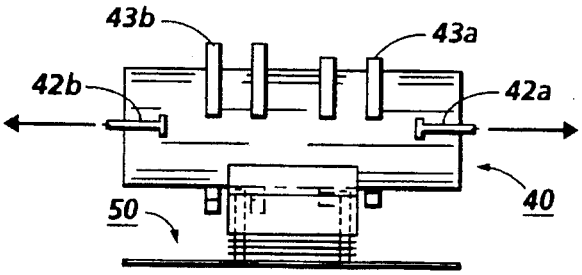
Figure 4A:
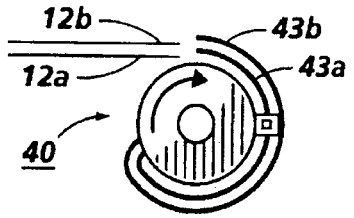
FIG. 4 (FIGS. 4A–4E) are schematic end views corresponding to the sequence of operating positions of FIG. 3 for that disk stacker paired output sheets merging system.
Figure 4B:
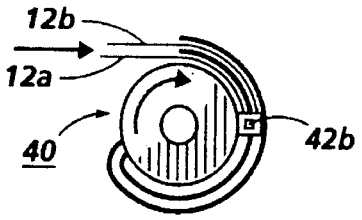
Figure 4C:
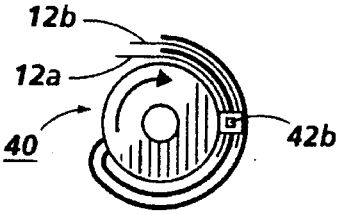
Figure 4D:
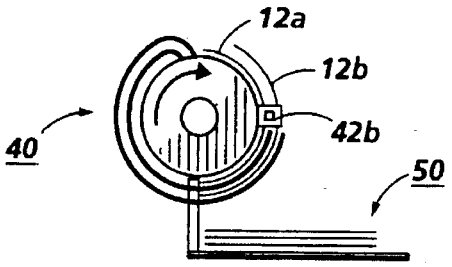
Figure 4E:
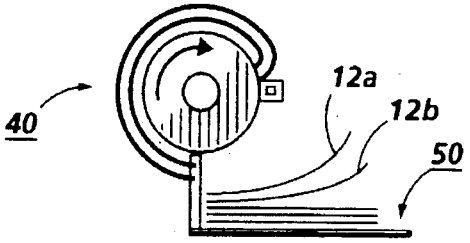

The printer 10 shown in FIGS. 1 and 2 has a common, and minimum two page width, printing or feed path 11, which path 11 is fed precut input copy sheets such as **12*a* and 12*b* in its process direction, paired, in parallel. The sheets 12*a* and 12*b* are fed concurrently by a pair of high capacity stack feeder/separators 14*a* and 14*b*, each feeding their respective sheets at about the same time from their respective high capacity stacking trays 16*a* and 16*b*. The elevator or other high capacity trays 16*a* and 16*b* and the feeders 14*a* and 14*b* may otherwise be conventional. Alternatively, sheet pairs 18***a* and 18*b* may be fed at any desired time or insertion point from alternate sheet trays 19*a* and 19*b* by two similar sheet feeders 21*a* and 21*b* shown therein. The input trays 16*a*, 16*b*, 19*a*, 19*b* preferably have separate stack elevators (conventional per se and not illustrated here) so as to allow them to be loaded or reloaded with different sheets or different amounts of sheets. This also allows the machine to run with unequal stack heights.

The paired sheets 12*a* and 12*b* (or 18*a* and 18*b*) are sequential fed side by side into the path 11, in its printing path direction, to provide dual image substrates, sequentially feeding pairs of separate precut copy sheets into the printing path in parallel, but maintained laterally separated by a lateral spacing distance such that they do not contact or interfere with one another, until after they are printed. One sheet of each pair remains inboard, and the other outboard, until they reach the compact lateral merging system 40, as will be described.

The two separator/feeders 14*a* and 14*b* may desirably be commonly driven. If they use air knives and/or vacuum feeding, as schematically shown, as in well known top VCF feeders, the air supplies and the valving or on/off controls may also be shared for the two feeders, for cost savings. Since acquisition times may still vary somewhat, a common conventional lead edge registration system is preferably provided for both sheets to be commonly registered, at a usual location downstream of the feeders in the sheet path. To express this another way, the two paired feeders may use many common parts (air system, drives, air knife manifold, and controls). If the sheets leave the two feeders 21*a*, 21*b* at slightly different times, due to, for example, different slippage on the illustrated VCF belts, the downstream lead edge sheet registration system 23 compensates and ensures that process direction registration is maintained. This can be a conventional stalled roller nip buckle registration system as illustrated. In this manner, both sheets can always arrive at the imaging station simultaneously, as a pair.

This lateral spacing between sheet pairs, and the lateral edge registration and alignment of each sheet of each pair, is provided here by a dual edge registration system 20*a* and 20*b* for edge registering the respective outside edges of each of said paired sheets to each of the opposite lateral side registration edges 22*a* and 22*b* of said printing path 11. The width of the path 11 is preferably such as to allow a substantial space, of at least several mm., between said paired sheets even for the largest size sheets 12*a* and 12*b* (or 18*a* and 18*b*) to be fed. In FIG. 1 two conventional but oppositely angled ball on belt registration transports 20*a* and 20*b* are shown. However, various of the above-cited other edge registration systems may be used instead.

Desirably the entire paper path and the feeder, registration and compiler system is compatible with sheets which are fed and imaged either short edge first or long edge first. Short edge first feeding typically requires at least a 17 inch wide processor, whereas long edge first feeding typically requires at least a 22 inch wide processor. In both cases, a slightly greater processor width, e.g, 2 cm, would be desirable to accommodate the desired lateral separation of the paired sheets. Preferably this lateral separation of the paired sheets is increased upon leaving the paired sheet feeders, as shown in FIG. 1, to insure edge registration towards the outside edges, and to accommodate misstacking or feeding initial lateral misregistrations.

Figure 5:
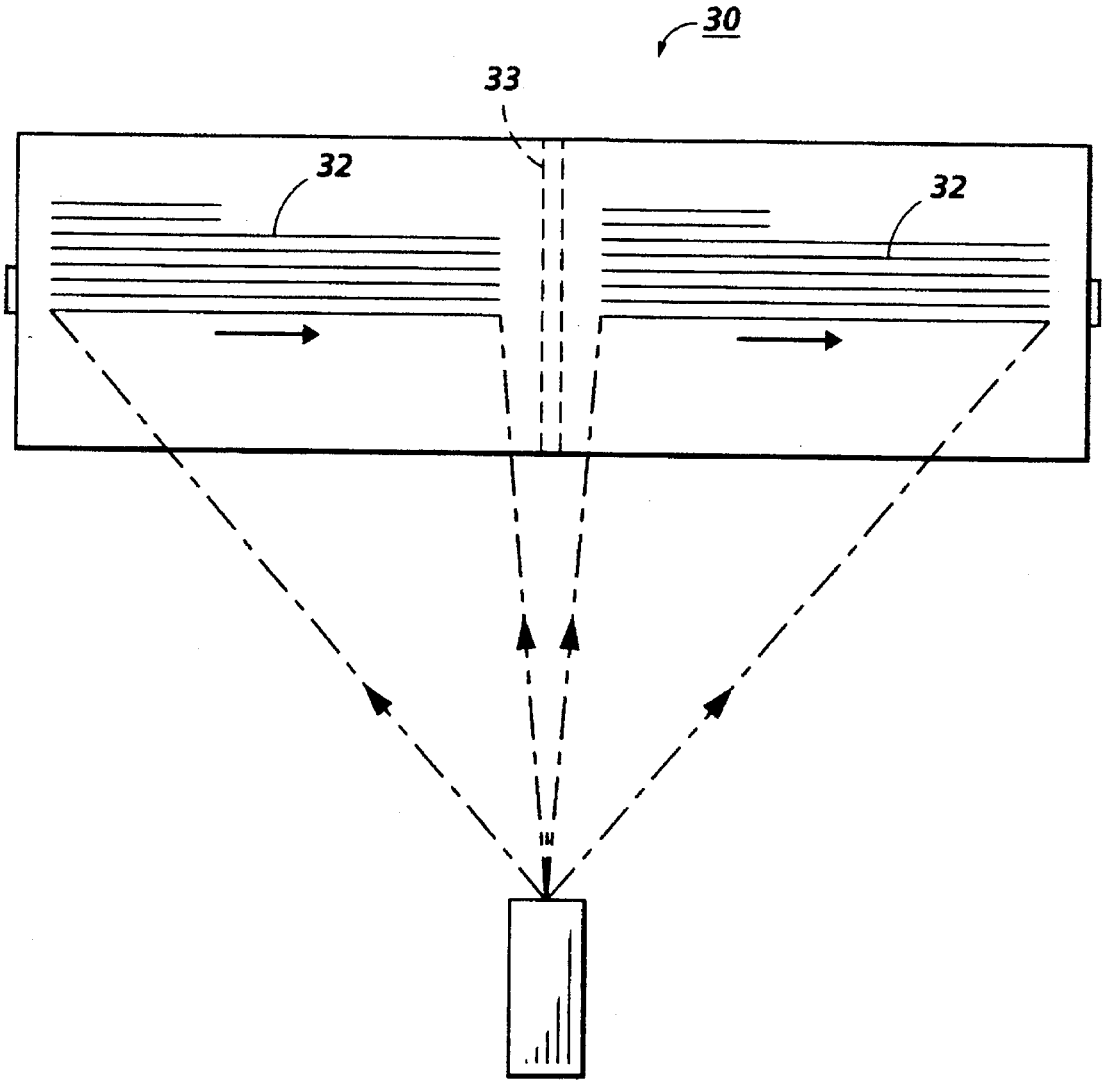
FIG. 5 is a schematic view of the operation of the imaging system of FIGS. 1 and 2.

Dual page images are then concurrently printed onto these dual image substrates 12*a* and 12*b* (or 18*a* and 18*b*) as they are paired side by side, but spaced apart, laterally transverse the printing path 11 direction. This "two up" printing effectively doubles the printing throughput rate or speed, as compared to printing only single images sequentially in the same printer. That is, the effect of running paper through a machine in a 2-up mode is that twice the throughput is achieved with the same process speed. However, it creates special sheet registration, image registration, collation and finishing problems. This printing, as previously noted, can be by conventional xerographic laser printing, e.g., a modulated laser light beam line by line laterally scanning a photoreceptor to generate latent images developed and transferred to the copy sheets. Alternatives include direct charge depositing electrography, full width array ink jet printing, lithography, etc. Here, however, the electronic imaging system 30, as particularly shown in FIG. 5, for line by line 32 simultaneous printing of both of said opposite edge registered paired sheets, provides a non-imaging line space 33 in said space between said paired sheets. That is, each printing line 32 must skip or non-print in the line space 33 corresponding to the space between the two paired sheets. Also, the two images are respectively separately registered from the two side registration edges 22*a* and 22*b*. Thus, the data stream effectively has a turn-off or non-print insertion time period automatically varied in proportion to the sheet lateral width, which determines the lateral space between paired sheets. Since the length of this blank space or gap 33 between the image data streams is equal to the known physical gap between the two registered sheets, and because the sheet edge registration position is known, the software algorithm for implementing the gap 33 can be relatively simple in this system. The sheet dimension may be conventionally provided from operator inputs and/or input tray sensors.

The electronic imaging system 30 here desirably prints two different page images on each said paired sheets, i.e., one page image on one sheet and the next consecutive page image on the other sheet of the pair. Then the next pair of sheets is printed with the next two consecutive pages, etc., until a job set is completed. Then the next job set is so consecutively printed. Thus, the system can provide for precollated output job sets, by additionally providing a sheet lateral merging system 40, as will be described.

After the paired sheets are simultaneously printed, they are fed on along the path 11 by feed rollers 44*a*, 44*b* to a sheet output lateral sheet merging and stacking system 40 for consecutively laterally shifting and overlapping said printed paired sheets on top of one another and for stacking consecutive said overlapped sheet pairs on top of one another, to provide a collated output of said two up printed precut copy sheets. In the example herein, particularly as shown in FIGS. 3A–3E and 4A–4E, this sheet output lateral sheet merging and stacking system 40 comprises a modified disk stacking system in which said lateral shifting and overlapping of said printed paired sheets on top of one another is provided while said paired sheets are arcuately held for increased beam strength. The paired sheets can both be simultaneous fed into the unit 40 in their side by side separated positions. Conventionally, as described in the above cited patents thereon, the sheets feed into arcuate disk finger slots 43*a* and 43*b* which hold the arcuately partially wrapped around the central axis of rotation of the unit 40. However, here, two sheets are in the unit 40 at one time, and one is held to a sightly different diameter of wrap than the other. For that purpose, as particularly shown in FIG. 2, one sheet of each pair enters the unit 40 at a slightly raised path position 41*b* versus the other sheet at a lower path position 41*a*. I.e., the two sheets paths slightly vertically diverge from one another before the sheet output. To keep the sheets aligned together, if one such vertically divergent path is slightly longer, one sheet therein may be fed slightly faster.

Here, one sheet 12*a* travels a slightly shorter path 41*a* since it must end up slightly below the other sheet, so it is fed by nip 44*a* to travel a little bit slower than its otherwise parallel sheet in nip 44*b*. This relative speed differential occurs after fusing the image.

In the unit 40, a lateral side shifting system 42 (42*a*, 42*b*) then engages and pushes at least one of the sheets of the pair towards and onto (over or under) the other sheet while both are so arcuately supported for increased beam strength, thus overlapping the two printed paired sheets on top of one another, before they are discharged. As shown here, both sheets may be pushed together by pushing each from its outside edge towards the other, by fingers 42*a* and 42*b*, respectively, while the sheets are held in and rotating with the disk unit 40. It will be appreciated however, that other lateral sheet merging systems may be used, such as modified forms of the above-cited sheet edge registration lateral movement systems.

Note that, unconventionally, the merging and output system 40 shown here is a center registered system, whereas the sheet feeders and registration devices here are a system which is side registered on opposite sides. Also note that the system 40 laterally merges sheets while the disks rotate, not after they have settled. The system 40 is very compact, unlike a merger while the sheets are travelling along a straight path, which would require much more space and footprint. Likewise, the system 40 does not require large web loops to merge two paper path streams. The system 40 is also handling two sheets simultaneously. The system 40 here is shown with 1 to N page order face-up printing, and provides simultaneous dual sheet inversion while merging the dual sheets, for collated face down stacking. However, it could also be used with sheets entering the system 40 face-down in N to 1 order. The system 40 could also be used with web fed two up web printed images which are cut into paired sheets before entering the system 40.

The now combined (superposed) sheet pair may then be conventionally compiled and finished and/or stacked with other such successively printed pairs. As noted and taught above, this disk system 40 may desirably provide compiling, and may optionally include a stacking system 50 which consecutively compiles (and optionally conventionally finishes) plural said overlapped sheet pairs into collated sets.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a high speed two up electronic printing system, with a printing path direction, in which dual page images are concurrently printed onto dual image substrates paired side by side laterally transverse said printing path direction to increase printing throughput speed, the improvement in said two up printing system comprising:

a dual high capacity cut sheet feeding system for loading and feeding pairs of separate precut copy sheets into said printing path substantially in parallel to provide said paired side by side dual image substrates for said concurrent printing;

a registration system for registering said paired side by side dual image substrate sheets with a space between said paired sheets;

an electronic imaging system for line by line simultaneous printing of both of said opposite edge registered paired sheets with a non-imaging line space in said space between said paired sheets;

said electronic imaging system printing two different page images on said paired sheets;

and a sheet output lateral sheet merging and stacking system for consecutively laterally shifting and overlapping said printed paired sheets on top of one another and for stacking consecutive said overlapped sheet pairs on top of one another, to provide a collated output of said two up printed precut copy sheets.

2. The high speed two up electronic printing system of claim 1, wherein said sheet output lateral sheet merging and stacking system comprises a disk stacking system in which said lateral shifting and overlapping of said printed paired sheets on top of one another is provided while said paired sheets are both arcuately held for increased beam strength and are both being inverted.

3. The high speed two up electronic printing system of claim 1, wherein said sheet output lateral sheet merging and stacking system laterally superposes said said printed paired sheets on top of one another while they are being arcuately supported and rotated.

4. The high speed two up electronic printing system of claim 1, wherein said registration system comprises a dual edge registration system for edge registering one edge of each of said paired side by side dual image substrate sheets to opposite lateral side edges of said printing path with a substantial space between said paired sheets.

5. The high speed two up electronic printing system of claim 1, wherein said sheet output lateral sheet merging and stacking system consecutively compiles and finishes plural said overlapped sheet pairs into plural bound collated sets.

6. In a high speed two up electronic printing system, with a printing path direction, in which dual page images are concurrently printed side by side onto image substrate material, paired laterally transverse said printing path direction, and outputted as two parallel individual sheets, to increase printing throughput, the improvement in said two up printing system comprising:

a feeding system for feeding image substrate material into said printing path for said paired side by side dual dual image concurrent printing;

an electronic imaging system for line by line simultaneous two up printing of two different page images onto said image substrate material;

said two different page images being outputted as two differently printed said parallel individual sheets;

and a sheet output lateral sheet merging and stacking system for laterally overlapping said two parallel individual printed output sheets on top of one another in sheet pairs, and for stacking consecutive said sheet pairs on top of one another, to provide a collated output of said two up printed sheets;

wherein said sheet output lateral sheet merging and stacking system comprises a disk stacking system which laterally shifts and superposes said printed paired sheets on top of one another while both sheets of said pair are being arcuately supported and rotated for inversion.

* * * * *